United States Patent [19]

Bucher

[11] Patent Number: 4,876,752

[45] Date of Patent: Oct. 31, 1989

[54] CONTROL DEVICE FOR AN AIR TURBULENCE MASSAGE DEVICE

[75] Inventor: Heinz Bucher, Rottweil, Fed. Rep. of Germany

[73] Assignee: Metronic Electronic GmbH, Rottweil, Fed. Rep. of Germany

[21] Appl. No.: 271,204

[22] Filed: Nov. 14, 1988

[30] Foreign Application Priority Data

Nov. 12, 1987 [DE] Fed. Rep. of Germany ..... 3738364

[51] Int. Cl.[4] ..... A61H 33/02

[52] U.S. Cl. ..... 4/542; 4/541; 4/543; 128/66; 261/DIG. 75

[58] Field of Search ..... 4/543, 541–542, 4/544–546, 491, 496, 492; 128/66; 261/DIG. 75, 121.1

[56] References Cited

U.S. PATENT DOCUMENTS

| | | | |
|---|---|---|---|
| 4,008,498 | 2/1977 | Thomas | 4/543 |
| 4,166,296 | 9/1979 | Darrah et al. | 4/543 |
| 4,409,693 | 10/1983 | Baumann | 4/543 |
| 4,592,100 | 6/1986 | Robertson et al. | 4/542 X |
| 4,637,080 | 1/1987 | Hutchinson | 4/544 X |
| 4,672,692 | 6/1987 | Savage | 4/543 |
| 4,742,584 | 5/1988 | Hoa | 4/542 |
| 4,780,917 | 11/1988 | Hancock | 4/542 |

FOREIGN PATENT DOCUMENTS

| | | |
|---|---|---|
| 1803255 | 8/1959 | Fed. Rep. of Germany . |
| 1812337 | 6/1960 | Fed. Rep. of Germany . |
| 8006791 | 6/1980 | Fed. Rep. of Germany . |
| 8230409 | 10/1982 | Fed. Rep. of Germany . |
| 3430879 | 10/1987 | Fed. Rep. of Germany . |

*Primary Examiner*—Henry K. Artis
*Attorney, Agent, or Firm*—Thomas W. Speckman; Douglas H. Pauley

[57] ABSTRACT

This invention relates to a control device for an air turbulence massage device having a housing. The housing accommodates a blower unit which can be driven by an electrical motor. The housing has a connecting piece for an air tube that is in communication with a turbulence matting. The housing accommodates a check valve device which, when the control device is shut off, prevents water from flowing back from the turbulence matting to the electrical motor and the blower unit. The housing comprises an external housing and a separate internal housing. Air flow is separated from a water discharge path leading from the internal housing such that the blower unit and the electrical motor never contact the water flowing into the housing and the water can flow out of the control device.

23 Claims, 2 Drawing Sheets

CONTROL DEVICE FOR AN AIR TURBULENCE MASSAGE DEVICE

BACKGROUND OF THE INVENTION

Field of the Invention

This invention relates to a control device for an air turbulence massage device having a connecting piece for an air tube in communication with a turbulence matting, an external housing having a lower and an upper housing part, a blower unit, and a device which prevents backflow of water from the turbulence matting to the blower unit and electrical motor drive.

Description of the Prior Art

A similar control device is taught by German Patent DE-PS 34 30 879. A similar device is also taught by German Utility Model DE-GM 80 06 791. The device for preventing the water backflow is constructed as a backflow-preventing or check valve which is held in a closed position by a permanent magnet and forced into an open position by compressed air produced by the blower unit. After the blower unit is shut down, the check valve is automatically brought back to the closed position by permanent magnets. The check valve is integrated into the connecting piece for the air tube or into the pressure output connecting piece of the blower unit. German Utility Model DE-GM 82 30 409 shows a check vale which is basically constructed in a similar manner and can also be integrated into the air tube. In the closed position of the check valve, water flowing back can flow out from the air tube through a discharge opening.

In such known control devices, the backflow of water to the electrical motor and the blower unit is only fully prevented if the check valve operates flawlessly. This is not absolutely ensured since the valve body of such types of check valve does not always occupy an unequivocally closed position. Thus a user sitting in a bathtub is not protected from dangers of current failures, current surges, and the like.

SUMMARY OF THE INVENTION

It is one object of this invention to provide a control device in which water that may penetrate into the control device is securely kept out of the electrical motor and the blower unit, and such water can completely flow out of the control device without contacting the electrical motor or the blower unit.

Water flowing back into the control device can reach the compressed air distribution chamber without flowing into the compressed air connecting piece. The water flows out of the compressed air distribution chamber and into a water collecting chamber formed between the internal housing and the external housing, from which the water can then flow out. The water discharge opening of the internal housing and the water outlet opening of the external housing are through holes. In a mounted control device, the through holes are positioned in the areas of the compressed air distribution chamber and the water collecting chamber which are positioned at a low point of the housing. Thus a complete discharge of the water flowing back into the control device is ensured. The compressed air connecting piece is preferably arranged above the connecting piece for the air tube and thus a further separation between the compressed air distribution chamber and the blower unit is achieved. The compressed air distribution chamber is in communication with only the external housing by way of a small, water discharge opening. A substantial pressure loss does not occur, since the cross section of the water discharge opening of the internal housing is negligibly small relative to the cross section of the connecting piece for the air tube.

According to one embodiment of this invention, the internal housing comprises a horizontally oriented casing-like chamber part and a cover sealing the open side of the chamber part. The connecting piece for the air tube is formed in the base of the chamber part. The external housing is provided in a wall area turned toward the connecting piece which has an insertion opening for the air tube. The cover of the internal housing is constructed as a support shell for the attachment of the blower unit. The cover of the internal housing, in addition to its separating function, has additional attaching capabilities.

The connection between the cover and chamber part of the internal housing is constructed such that the cover has a circumferential catch mounting which engages with the wall of the casing-like chamber part having a circumferential catching bar.

According to one embodiment of this invention, air produced by the blower unit is supplied through a compressed air connecting piece that is integrally formed on the cover. Outside of the compressed air distributing chamber, the cover forms a compressed air chamber with a sealing ring attached to the blower unit in the general area of the blower unit. The compressed air produced by the blower unit is fed into the compressed air chamber and can be further conducted into the compressed air distributing chamber through the compressed air connecting piece.

In another embodiment according to this invention, the compressed air connecting piece is positioned with one outlet opening at a defined distance to the base of the chamber part of the internal housing. A protective casing of finely-porous material, such as plastic foam material, which extends to the base of the chamber part is psitioned as far as the end of the compressed air connecting piece so that the noise level of the compressed air flowing into the compressed air distributing chamber is reduced. The protective casing also prevents splashed water, which penetrates into the compressed air distributing chamber, from reaching the compressed air connecting piece. The protective casing allows the compressed air supplied by the blower unit to the compressed air distributing chamber to flow without significant pressure losses.

The inlet flow of the compressed air into the compressed air distributing chamber is further improved by the base of the chamber part of the internal housing projecting into the protective casing, with a conical distributor body, which ends in front of the outlet opening of the compressed air connecting piece.

In accordance with one embodiment of this invention the sealing ring attached to the blower unit and the circumferential connecting bars is integrally formed on the lower housing part and the upper housing part of the external housing. The water collecting chamber is sealed off from the blower unit. In the area of the base of the chamber part, the internal housing is sealed off, with a sealing element, from the external housing. The water collecting chamber is also unequivocally separated or sealed off from the electrical motor and the blower unit.

The backflow of water is more restricted by having a strainer screen installed in the end section of the connecting piece turned toward the compressed air distributing chamber and/or by having the end section closed with a wall that has inlet openings. The strainer screen blocks foreign materials contained in the water from the control device.

In accordance with one embodiment, the connecting piece of the chamber part of the internal housing is extended as a valve casing into the compressed air distributing chamber. A valve conical body, in the valve casing, with a magnetically conductive closing plate is positioned in an adjustable manner. The sealing plate is oriented away from the connecting piece by a ring magnet which is securely mounted in the valve casing. Thus only in case of disturbance does the water reach the compressed air distributing chamber and the water can flow out from the same.

Further protection is achieved by mounting the ring magnet in a forward accommodation of a connecting casing. A sealing ring seals the ring magnet with respect to the valve casing, and abuts with the other frontal side on the cover of the internal housing. The connecting casing is mounted on an inwardly directed projection. The connecting casing preferably has diametrically positioned air inlet slots. The water flowing back into the control device can only reach the compressed air distributing chamber by flowing through the longitudinal slots of the connecting casing. Thus the separation of the compressed air connecting piece is signficiantly improved.

BRIEF DESCRIPTION OF THE DRAWINGS

This invention is illustrated in further detail by preferred embodiments shown in the drawings wherein.

DESCRIPTION OF THE PREFERRED EMBODIMENTS

Figure 1:
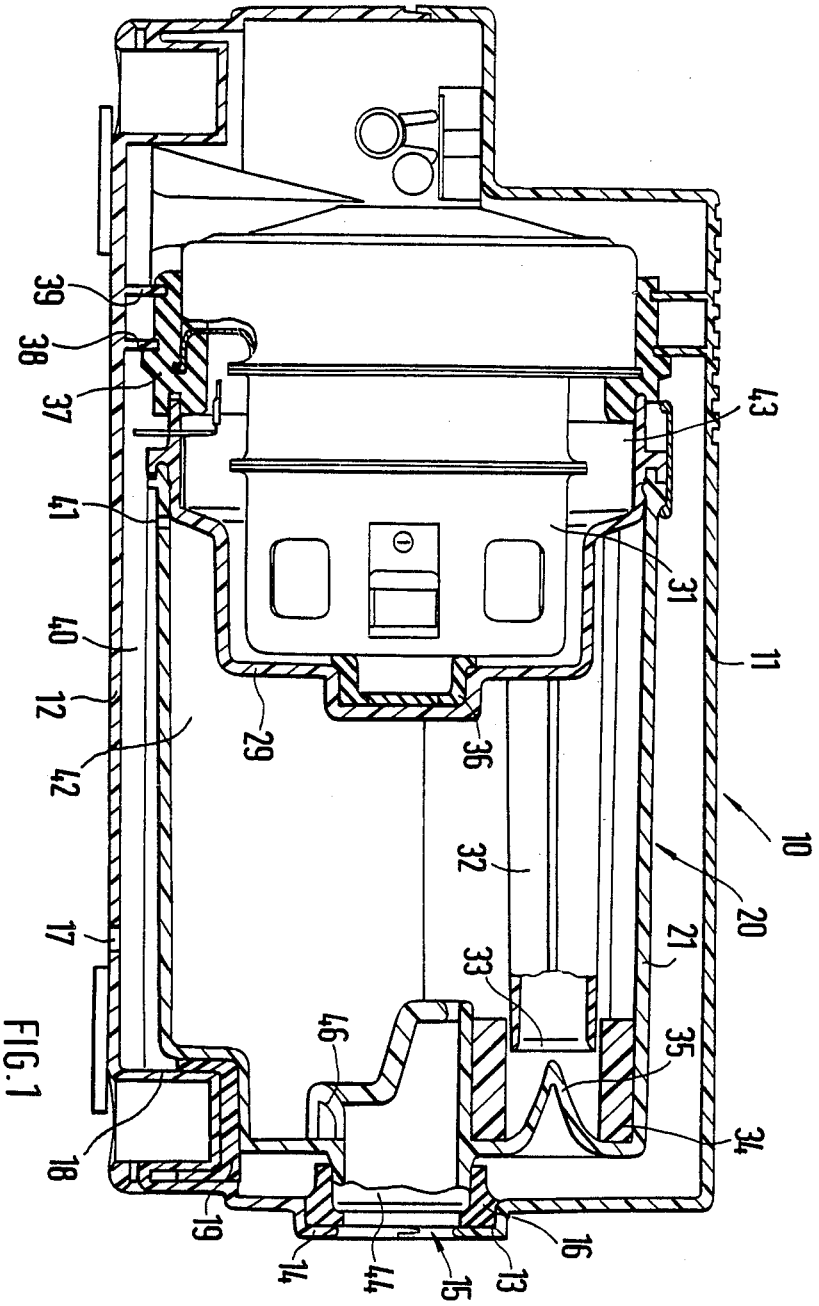
FIG. 1 shows a vertical cross section through the control device according to one embodiment of this invention.

As shown in the vertical cross section in accordance with FIG. 1, the external housing (10) comprises the shell-like lower housing part (12) and the shell-like upper housing part (11). The blower unit (31), driven by the electrical motor, is inserted into the external housing (10) in the right-hand part, relative to the position as shown in FIG. 1. The sealing ring (37) and the circumferential connecting bars (38 and 39) which are integrally formed on the lower housing part (12) and the upper housing part (11), close and seal the electrical connection side of the blower unit (31) in the external housing (10). Such electrical connection of the blower unit (31) is not an important aspect of this invention, relating to prevention of the backflow of the water.

The internal housing (20) comprising the casing-like chamber part (21) and the cover (29) is positioned in the ext.ernal housing (10). The chamber part (21) is horizontally positioned. The cover (29) is turned toward the blower unit (31) as a support shell for the blower unit (31). An elastic intermediate part (36) is used to connect the cover (29) to the blower unit (31). The cover (29) has, in its edge, a circumferential engagement catch groove into which a circumferential engaging bar engages on the wall of the chamber part (21). The internal housing (20) forms the compressed air distributing chamber (42). The connecting piece (44) for an air tube is integrally formed in the base of the chamber part (21). The lower housing part (12) and the upper housing part (11) have their horizontal separating plane located on the central axis of the connecting piece (44) and have semicircular shaped projections (13 and 14) which enclose the round inlet aperture (15). The connecting piece of the air tube can be inserted into the connecting piece (44) of the internal housing (20). Thus the sealing ring (16) seals the connecting piece (44) to the external housing (10). The compressed air distributing chamber (42) formed by the internal housing (20) receives compressed air through the compressed air connecting piece (32).

Figure 2:
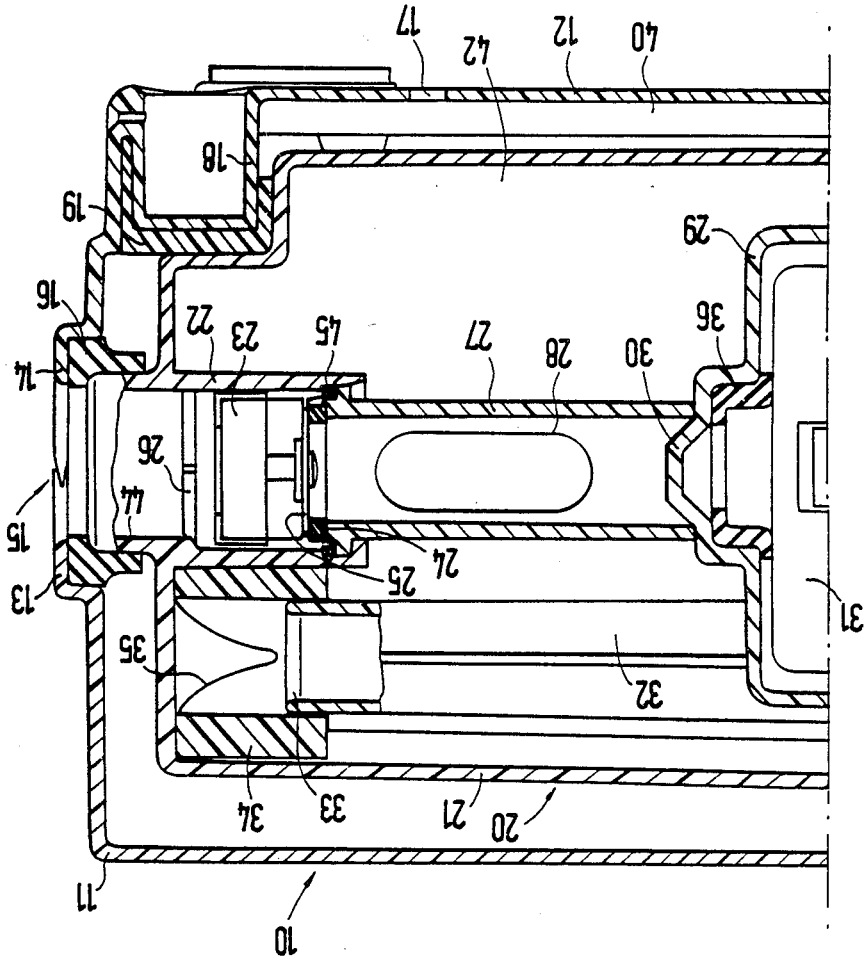
FIG. 2 shows an enlarged cross-sectional partial area with the internal housing of the control device and an additional magnetic check valve inserted therein.

The compressed air connecting piece (32) is integrally formed in the cover (29) and is positioned above the connecting piece (44). The cover (29) and the sealing ring (37) attached to the blower unit (31) seals the compressed air chamber (43) into which the compressed air produced by the blower unit (31) is introduced. The compressed air connecting piece (32) is used to introduce compressed air into the compressed air distributing chamber (42) of the internal housing (20). The compressed air connecting piece (32) is positioned with its outlet opening (33) at a predetermined distance to the base of the chamber part (21). The finely-pored protective casing (34), which preferably consists of plastic foam material, extends up to the base of the chamber part (21) and is moved up to the end of the compressed air connecting piece (32). The protective casing (34) allows the compressed air flowing into the compressed air distributing chamber (42) to flow without significant pressure losses, and with a reduction of the inlet flow noise level and further prevents splashed water, which enters the compressed air distributing chamber (42) through the connecting piece (44), from penetrating into the compressed air connecting piece (32). The connecting piece (44) can partially project into the compressed air distributing chamber (42) and be sealed with a wall which only supports inlet openings (46). As shown in FIG. 2, a screen (26), which keeps out foreign materials contained in the water, can additionally be placed in the connecting piece (44), as will be further described in this specification.

The compressed air flowing in through the compressed air connecting piece (32) is distributed by the conical distributor body (35) on the base of the chamber part (21), and oriented toward the internal wall of the protective casing (34). After passing the protective casing (34), the compressed air flows into the compressed air distributing chamber (42) from which the compressed air then flows through the connecting piece (44) to the air tube and into the turbulence matting.

If water flows back through the air tube, then the water flows through the connecting piece (44) and the inlet opening (46) into the compressed air distributing chamber (42). The water discharge opening (41), through which the backflowing water flows out of the internal housing (20), is installed at a low point of the chamber part (21). Since the cross section of the water discharge opening (41) is very small relative to the cross section of the connecting piece (44), no significant pressure losses occur during operation of the blower unit (31). The backflowing water flows from the internal housing (20) without coming into contact with the blower unit (31 and its electrical motor or its electrical connection side. The water flowing out from the internal housing (20) flows into the water collecting chamber (40) which is formed between the internal housing (20) and the external housing (10). The sealing ring (37) also seals the water collecting chamber (40) from the blower unit (31) and the electrical connection of the blower unit (31). The sealing element (19) in the area of the base of the chamber part (21) seals the water collecting chamber (40) from the lower housing part (12), so that the water collecting chamber (40) is separated on both sides from the blower unit (31) and the internal housing (20). The sealing element (19) is U-shaped and is placed around an integrally formed accommodating mount (18) which is provided for the attachment of the control device to a wall. The water collecting chamber (40) has, at a low point of the housing part (12), a water discharge opening (17) through which water in the water collecting chamber (40) flows out of the control device. The water discharge opening (17) is positioned at a low point of the lower housing part (12), if the control device is mounted or suspended on the wall.

As shown in the enlarged cross-sectional partial view of FIG. 2, the connecting piece (44) can be extended into the compressed air distributing chamber (42) as a valve casing (22). The filter screen (26) which keeps foreign materials in the backflowing water from entering the compressed air distributing chamber (42) is installed at the transition from the connecting piece (44) to the valve casing (22). The valve casing (22) accommodates the conical valve body (23) which is inserted in an adjustable manner and connected with the locking plate (25). The locking plate (25) comprises magnetically conductive material and is tightened with the ring magnets (24). When the blower unit (31) is shut off, the locking plate (25) is tightened by the ring magnets (24) and held in the closed position, in which it locks the valve casing (22). As soon as the blower unit (31) is switched on, the attracting magnetic force of the ring magnets (24) is overcome and the locking plate (25) opens the passage through the valve casing (22) and the connecting piece (44) for the compressed air. The conical valve body (23) is hollowed out in the center and, in the open position of this magnetic backflow-prevention or check valve, abuts a projection of the connecting piece (44). As soon as the blower unit (31) is switched off, the ring magnet (24) tightens the locking plate (25) which seals the valve casing (22). The connecting casing (27) is inserted into the valve casing (22) and the sealing ring (45) seals the transition from the valve casing (22) to the connecting casing (27).

The connecting casing (27) abuts on the cover (29) of the internal housing (20) and the projection (30) centers the connecting casing (27) and securedly fastens it on the cover (29). Two diametrically positioned air inlet slots (28), which produce the connection of the compressed air distributing chamber (42) to the valve casing (22), through the check valve for the connecting piece (44) for the air tube, inserted into the connecting casing (27). The air inlet slots (28) are positioned in a horizontal plane, so that the water discharging from the connecting casing (27) is not directed in the direction toward the compressed air connecting piece (32) and does not flow into the lower space of the internal housing (20). This additional protection in the compressed air distributing chamber (42) makes the device safer.

I claim:

1. A control device for an air turbulence massage device having a connecting piece for an air tube leading to a turbulence matting, an external housing having a lower and an upper housing part, a blower unit driven by motor means, a water discharge opening at a low point of said external housing, and a check valve device which when the blower unit is switched off prevents a backflow of water from said turbulence matting to said motor means and said blower unit, said control device comprising:

an internal housing (20) forming a separate compressed air distributing chamber (42) positioned in said external housing (10) outside of said blower unit (31);

said internal housing (20) having a connecting piece (44) for said air tube which is sealed off from said external housing (10) and is in communication with an insertion opening (15) of said external housing (10);

compressed air produced by said blower unit (31) flowable through a compressed air connecting piece (32) into said compressed air distributing chamber (42) positioned above said connecting piece (44) for said air tube;

said internal housing (20) having an internal housing water discharge opening (41) at a low point of said compressed air distributing chamber (42) behind a mount of the control device;

said internal housing water discharge opening (41) of said compressed air distributing chamber (42) in communication with a water collecting chamber (40) formed between said lower housing part (12) of said external housing (10) and said internal housing (20), said water discharge opening (41) sealed off from said motor means and said blower unit (31); and an external housing water discharge opening (17) positioned at a low point of said water collecting chamber (40) of said lower housing part (12) behind said mount of the control device.

2. A control device in accordance with claim 1, wherein said internal housing (20) comprises a horizontally oriented, casing-like chamber part (21) and a cover (29) sealing an open side of a chamber part (21);

said connecting piece (44) for said air tube formed in a base of said chamber part (21); and a wall area of said external housing (10) turned toward said connecting piece (44) having insertion opening (15) for said air tube.

3. A control device in accordance with claim 2, wherein said cover (29) of said internal housing (20) further comprises a support shell for attaching said blower unit (31).

4. A control device in accordance with claim 3, wherein a border area of said cover (29) has a circumferential catch engaging with a chamber part wall of casing-like said chamber part (21) having a circumferential engaging bar.

5. A control device in accordance with claim 4, wherein said compressed air connecting piece (32) is integrally formed on said cover (29), outside said compressed air distributing chamber (42) a sealing ring (37) is attached to said blower unit (31) near said blower unit (31) and said cover (20) forms a compressed air chamber (43) into which said compressed air produced by said blower unit (31) can flow, and said compressed air can flow via said compressed air connecting piece (32) into said compressed air distributing chamber (42).

6. A control device in accordance with claim 5, wherein said compressed air connecting piece (32) is positioned with a discharge opening (33) at a distance from said base of said chamber part (21) of said internal housing (20), and a protective casing (34) of finely-porous material, extending up to said base of said chamber part (21), is positioned up to a compressed air connecting piece end of said compressed air connecting piece (32).

7. A control device in accordance with claim 6, wherein said base of said chamber part (21) of said internal housing (20) projects with a conical distributor body (35) into said protective casing (34) which terminates in front of said discharge opening (33) of said compressed air connecting piece (32).

8. A control device in accordance with claim 7, wherein a sealing ring (37) attached to said blower unit (31) and a plurality of circumferential connecting bars (38, 39) integrally formed on said lower housing part (12) and said upper housing part (11) of said external housing (10) seal said water collecting chamber (40) from said blower unit (31); and a sealing element (19) is used to seal off said internal housing (20) from said external housing (10) in a base area of said base of said chamber part (21).

9. A control device in accordance with claim 8, wherein a screen (26) is placed into a connecting piece end section of said connecting piece (44) turned toward said compressed air distributing chamber (42); and said connecting piece end section is sealed with a wall having inlet openings (46).

10. A control device in accordance with claim 9, wherein said connecting piece (44) of said chamber part (21) of said internal housing (20) is extended as a valve casing (22) into said compressed air distributing chamber (42);

a conical valve body (23) having a magnetically conductive locking plate (25) is adjustably mounted in said valve casing (22); and said locking plate (25) is rotated away from said connecting piece (44) with a ring magnet (24) which is securely held in said valve casing (22).

11. A control device in accordance with claim 10, wherein said ring magnet (24) is held in a forward accommodation of a connecting casing (27) which is sealed with respect to said valve casing (22) with a sealing ring (45), and said connecting casing (27) abuts a forward side of said cover (29) of said internal housing (20);

said connecting casing (27) is held on an inwardly-direct:ed projection (30) of said cover (29); and said connecting casing (27) has a plurality of diametrically positioned air inlet slots (28).

12. A control device in accordance with claim 2, wherein a border area of said cover (29) has a circumferential catch engaging with a chamber part wall of casing-like said chamber part (21) having a circumferential engaging bar.

13. A control device in accordance with claim 2, wherein said compressed air connecting piece (32) is integrally formed on said cover (29), outside said compressed air distributing chamber (42) a sealing ring (37) is attached to said blower unit (31) near said blower unit (31) and said cover (20) forms a compressed air chamber (43) into which said compressed air produced by said blower unit (31) can flow, and said compressed air can flow via said compressed air connecting piece (32) into said compressed air distributing chamber (42).

14. A control device in accordance with claim 2, wherein said compressed air connecting piece (32) is positioned with a discharge opening (33) at a distance from said base of said chamber part (21) of said internal housing (20), and a protective casing (34) of finely-porous material, extending up to said base of said chamber part (21), is positioned up to a compressed air connecting piece end of said compressed air connecting piece (32).

15. A control device in accordance with claim 2, wherein said base of said chamber part (21) of said internal housing (20) projects with a conical distributor body (35) into a protective casing (34) which terminates in front of a discharge opening (33) of said compressed air connecting piece (32).

16. A control device in accordance with claim 5, wherein a sealing ring (37) attached to said blower unit (31) and a plurality of circumferential connecting bars (38, 39) integrally formed on said lower housing part (12) and said upper housing part (11) of said external housing (10) seal said water collecting chamber (40) from said blower unit (31); and a sealing element (19) is used to seal off said internal housing (20) from said external housing (10) in a base area of said base of said chamber part (21).

17. A control device in accordance with claim 1, wherein a screen (26) is placed into a connecting piece end section of said connecting piece (44) turned toward said compressed air distributing chamber (42); and said connecting piece end section is sealed with a wall having inlet openings (46).

18. A control device in accordance with claim 2, wherein said connecting piece (44) of said chamber part (21) of said internal housing (20) is extended as a valve casing (22) into said compressed air distributing chamber (42);

a conical valve body (23) having a magnetically conductive locking plate (25) is adjustably mounted in said valve casing (22); and said locking plate (25) is rotated away from said connecting piece (44) with a ring magnet (24) which is securely held in said valve casing (22).

19. A control device in accordance with claim 18, wherein said ring magnet (24) is held in a forward accommodation of a connecting casing (27) which is sealed with respect to said valve casing (22) with a sealing ring (45), and said connecting casing (27) abuts a forward side of said cover (29) of said internal housing (20);

said connecting casing (27) is held on an inwardly-directed projection (30) of said cover (29); and said connecting casing (27) has a plurality of diametrically positioned air inlet slots (28).

20. A control device in accordance with claim 8, wherein a screen (26) is placed into a connecting piece end section of said connecting piece (44) turned toward said compressed air distributing chamber (42).

21. A control device in accordance with claim 8, wherein a connecting piece end section is sealed with a wall having inlet openings (46).

22. A control device in accordance with claim 1, wherein a screen (26) is placed into a connecting piece end section of said connecting piece (44) turned toward said compressed air distributing chamber (42).

23. A control device in accordance with claim 1, wherein a connecting piece end section is sealed with a wall having inlet openings (46).

* * * * *